US006899383B2

(12) United States Patent
Hwang

(10) Patent No.: US 6,899,383 B2
(45) Date of Patent: May 31, 2005

(54) FOLDING CHAIR

(76) Inventor: Joo-Hwan Hwang, 595-17 Sincheon-Dong, Siheung-City, Kyonggi-Do, 429-827 (KR)

( * ) Notice: Subject to any disclaimer, the term of this patent is extended or adjusted under 35 U.S.C. 154(b) by 0 days.

(21) Appl. No.: 10/450,749

(22) PCT Filed: Nov. 29, 2001

(86) PCT No.: PCT/KR01/02065

§ 371 (c)(1),
(2), (4) Date: Jun. 16, 2003

(87) PCT Pub. No.: WO02/47514

PCT Pub. Date: Jun. 20, 2002

(65) Prior Publication Data

US 2004/0036323 A1 Feb. 26, 2004

(30) Foreign Application Priority Data

Dec. 16, 2000 (KR) ..... 2000-77518

(51) Int. Cl.[7] ..... A47C 4/00

(52) U.S. Cl. ..... 297/16.2; 297/16.1; 297/42; 297/45; 297/44

(58) Field of Search ..... 297/44, 45, 16.2, 297/42, 423.39, 423.4

(56) References Cited

U.S. PATENT DOCUMENTS 5,335,962 A * 8/1994 Gera ..... 297/232
6,045,177 A * 4/2000 Grace ..... 297/45
6,149,238 A * 11/2000 Tsai ..... 297/411.43
6,179,374 B1 * 1/2001 Tang ..... 297/45
6,209,951 B1 * 4/2001 Han ..... 297/45
6,322,138 B1 * 11/2001 Tang ..... 297/45
6,499,804 B1 * 12/2002 Wu ..... 297/381
6,601,912 B1 * 8/2003 Chen ..... 297/45
6,698,827 B2 * 3/2004 Le Gette et al. ..... 297/16.2

FOREIGN PATENT DOCUMENTS

| | | |
|---|---|---|
| JP | 12-135144 | 5/2000 |
| KR | 98-21954 | 6/1999 |
| KR | 99-44920 | 6/1999 |
| KR | 99-6735 | 7/1999 |

* cited by examiner

*Primary Examiner*—Peter M. Cuomo
*Assistant Examiner*—Erika Garrett
(74) *Attorney, Agent, or Firm*—Jordan and Hamburg LLP

(57) ABSTRACT

Disclosed is a folding chair comprising a frame and a seat sheet, which has means for protecting a user's vertebral column and means for expanding the seat to improve its seating comfort and stability. The expanding means are connected to both sides of the seat, and the protecting means is coupled at its opposite ends to armrests, upper portions of frame elements or the expanding means. The expanding means are hanged on projections formed by bending upper portions of the front frame elements. The protecting means is held at a certain height on a back rest of the chair but being allowed to be laterally moved by holding means, thereby enabling length of the protecting means to be adjusted. The folding chair may have one or more means for protecting a user's vertebral column.

20 Claims, 20 Drawing Sheets

【FIG.1】
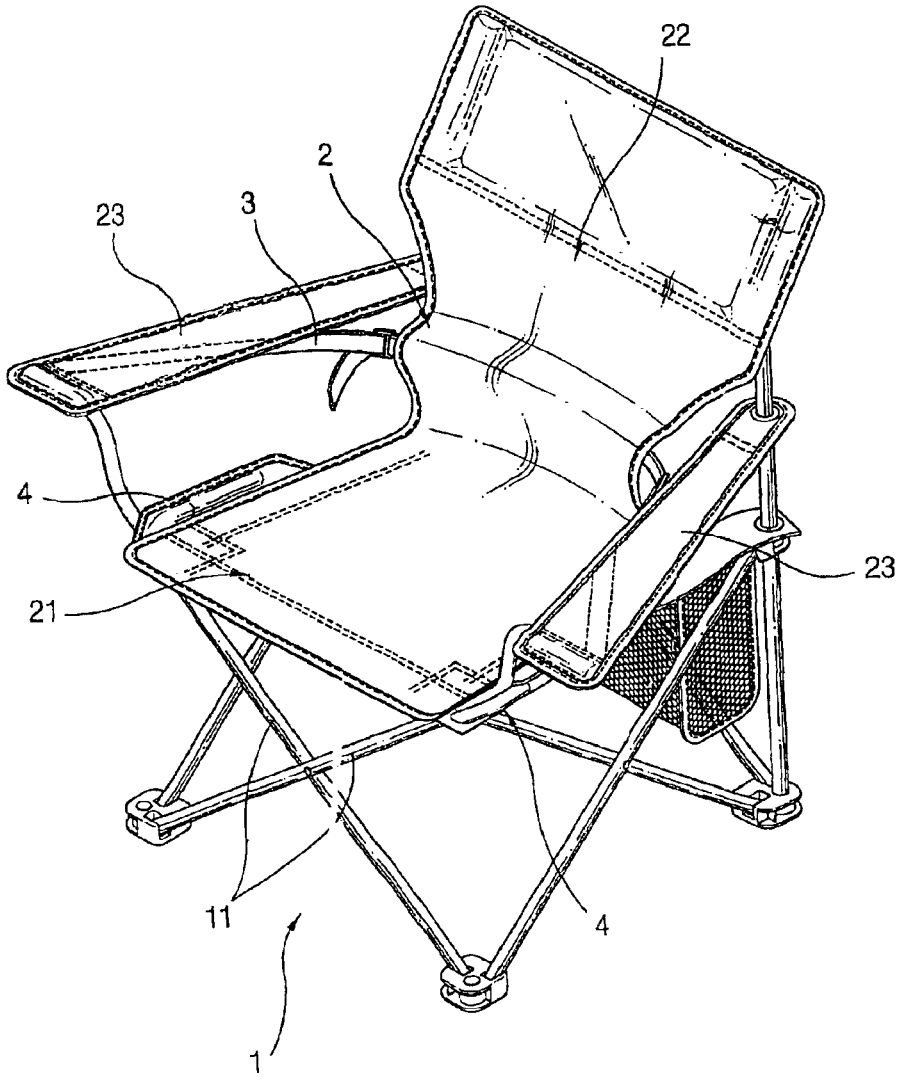

【FIG.2】
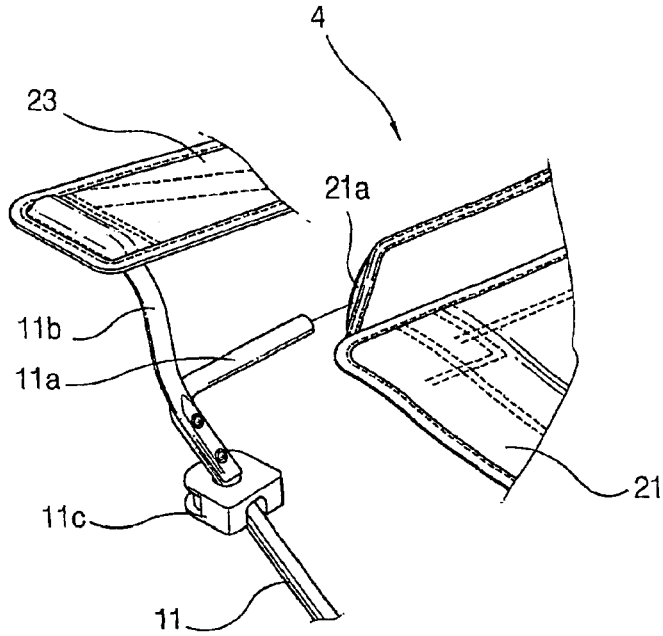
【FIG.3】
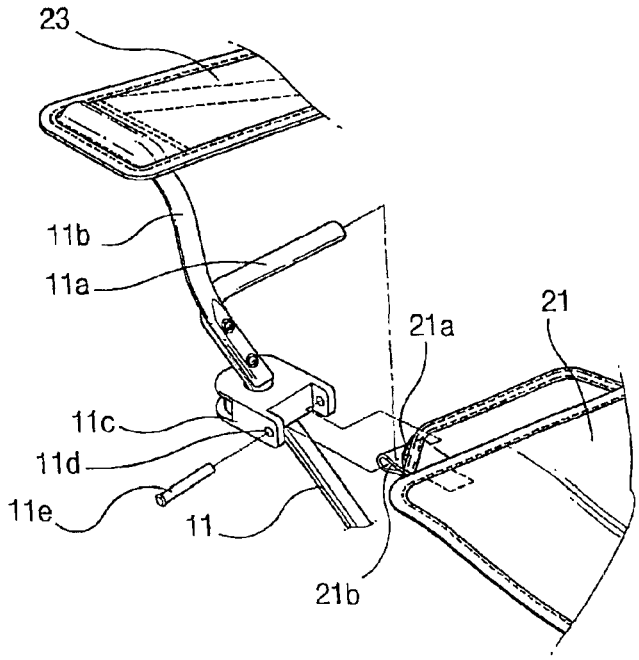

【FIG.4】
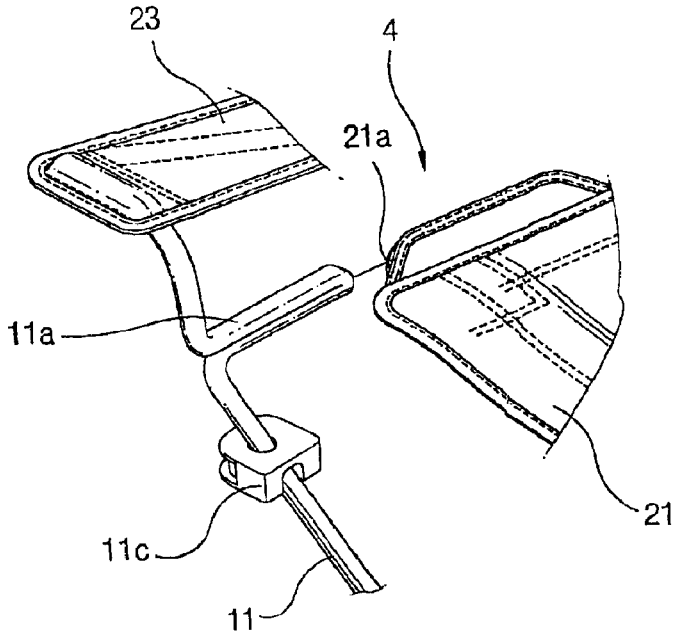
【FIG.5】
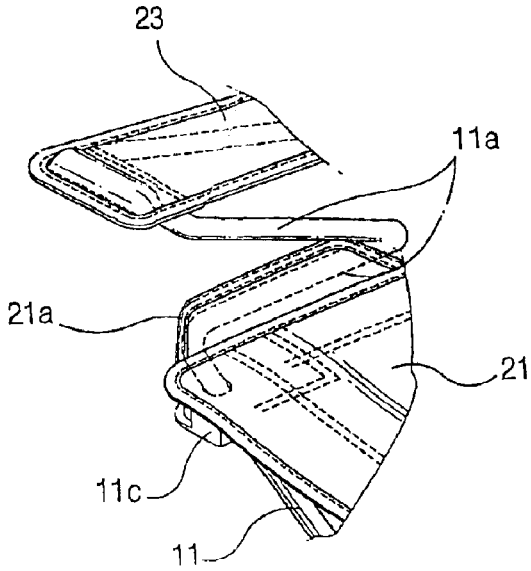

【FIG.6】
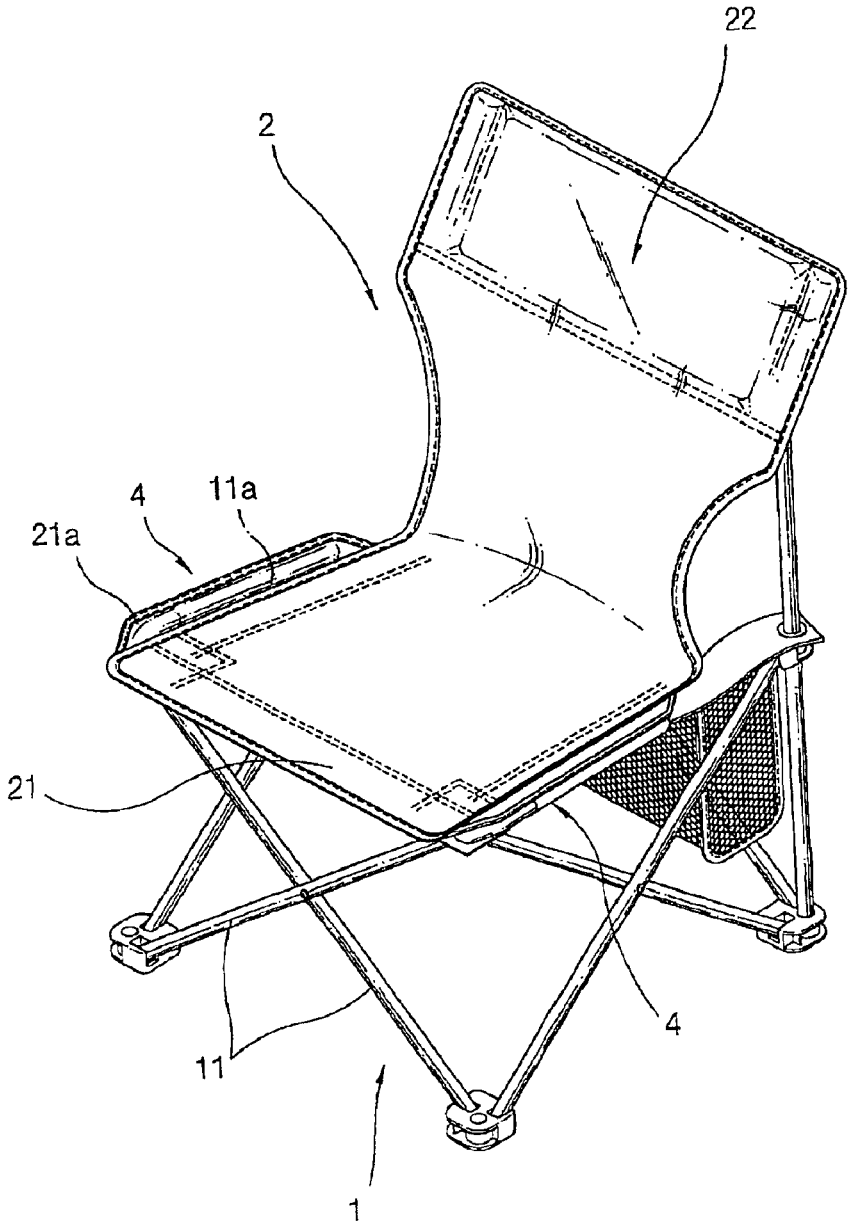

【FIG.7】
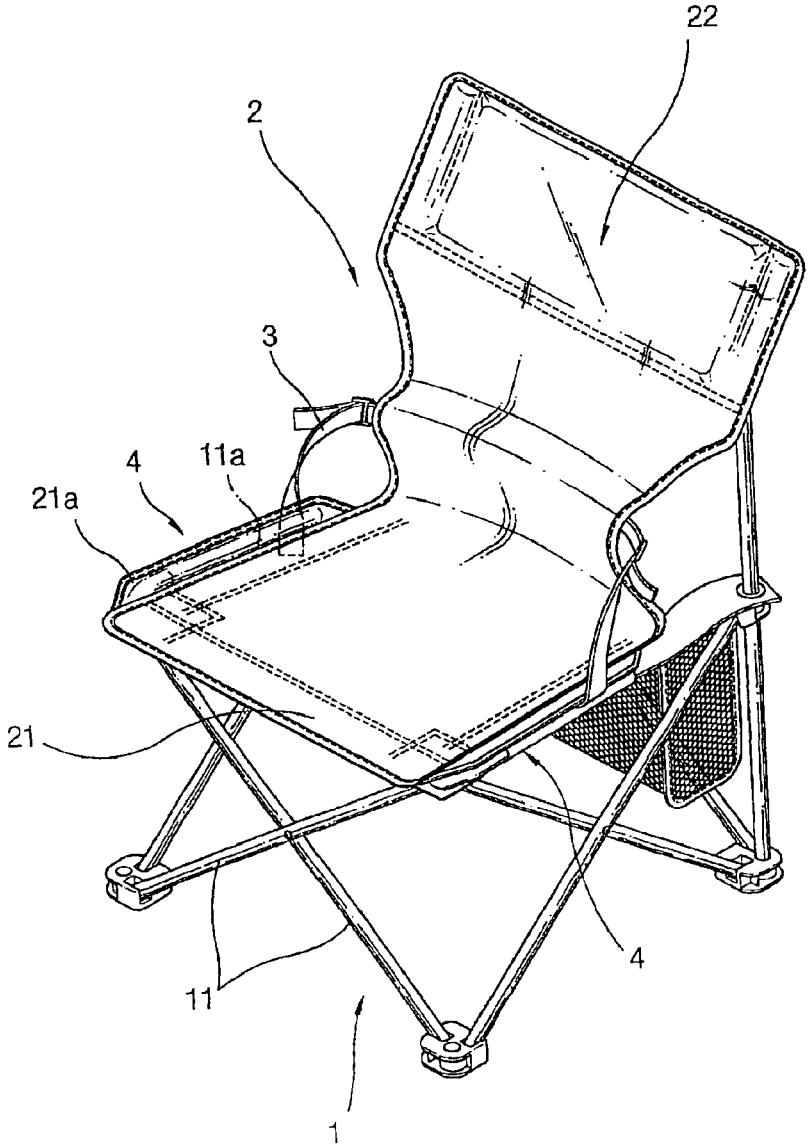

【FIG.8】
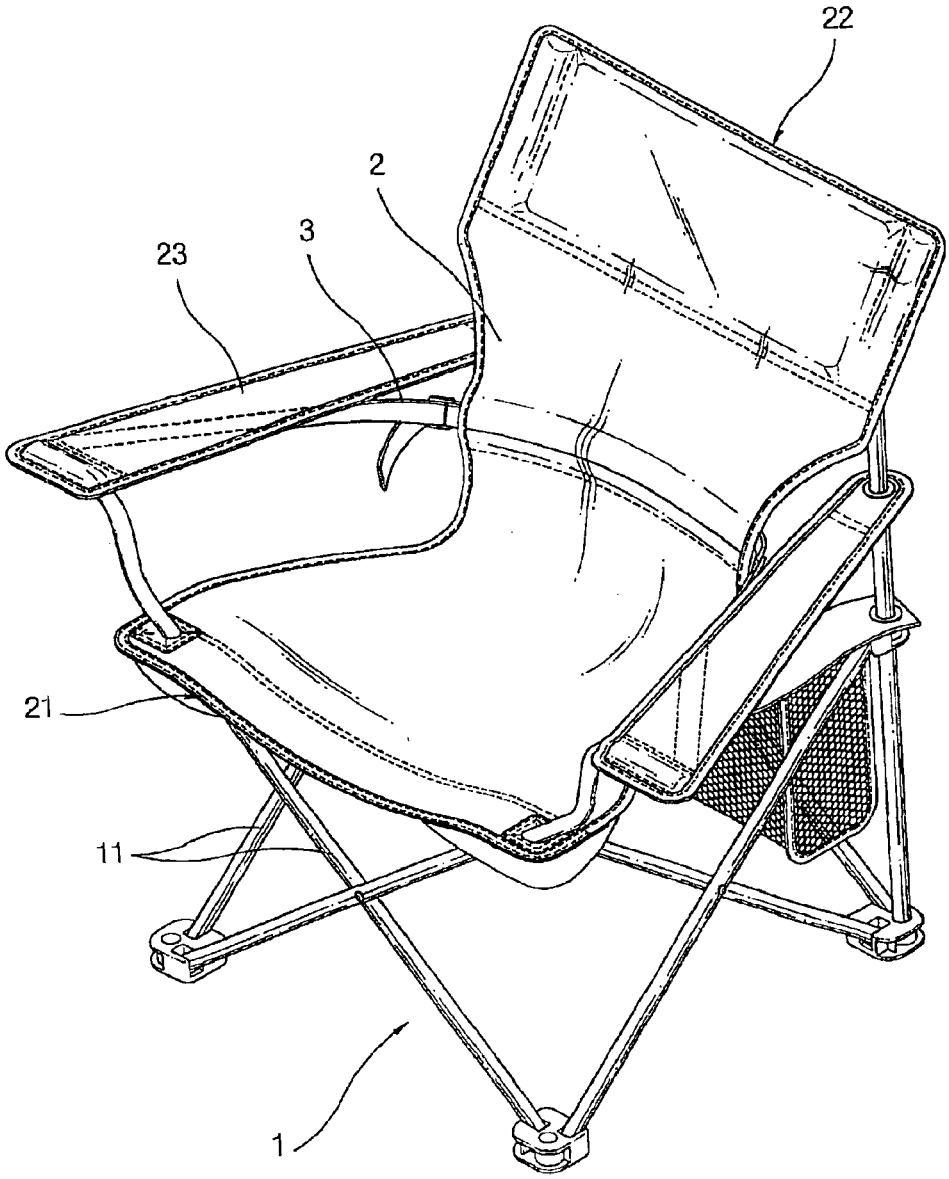

【FIG.9】
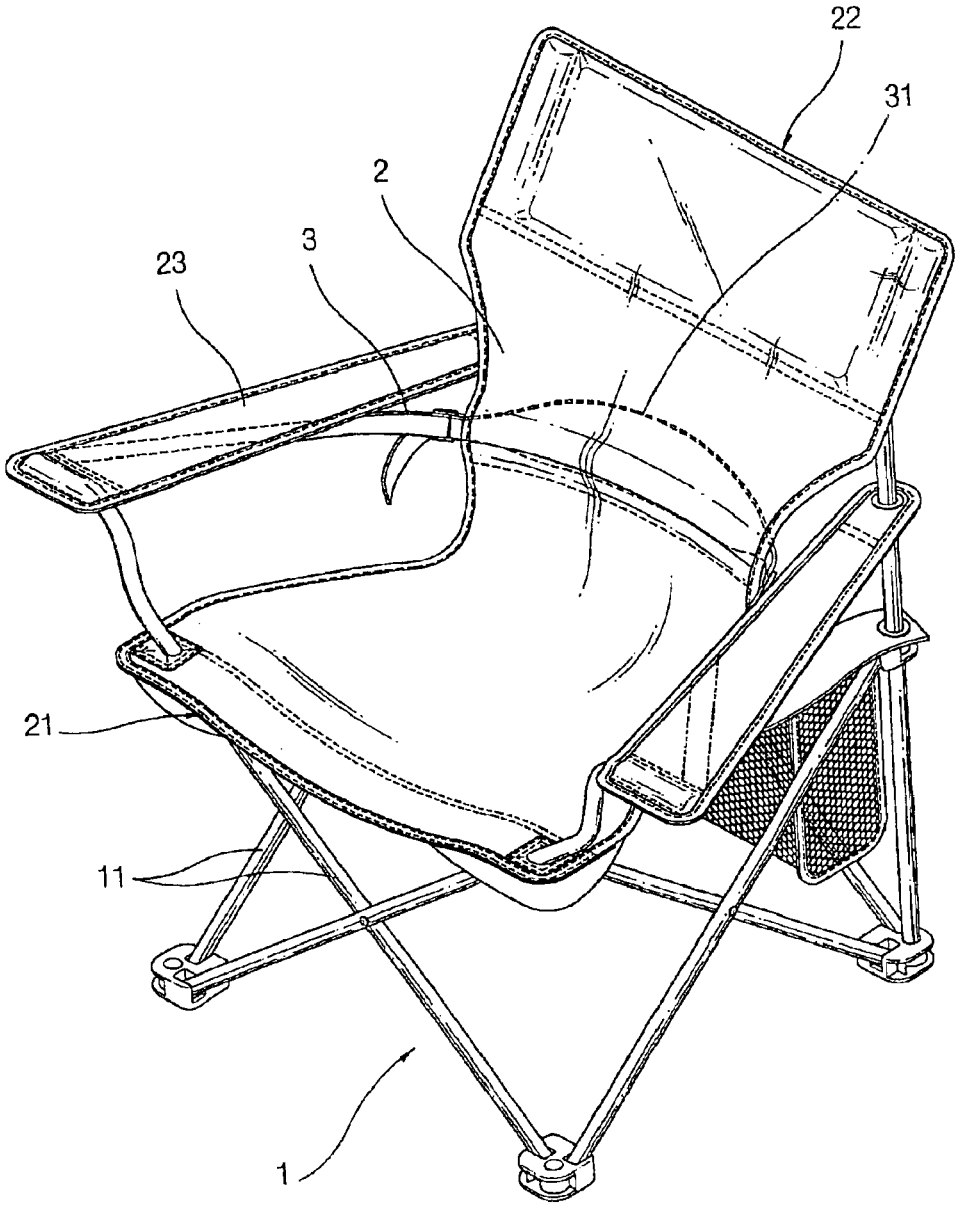

【FIG.10】
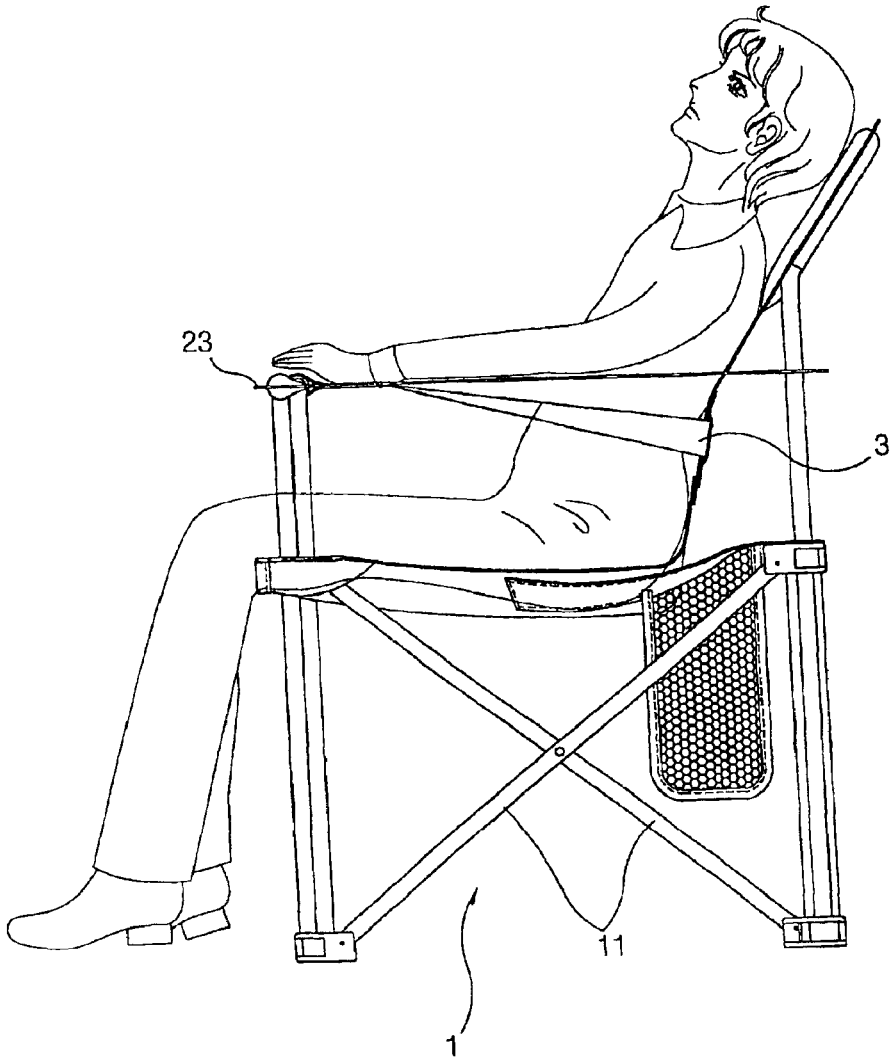

【FIG.11】
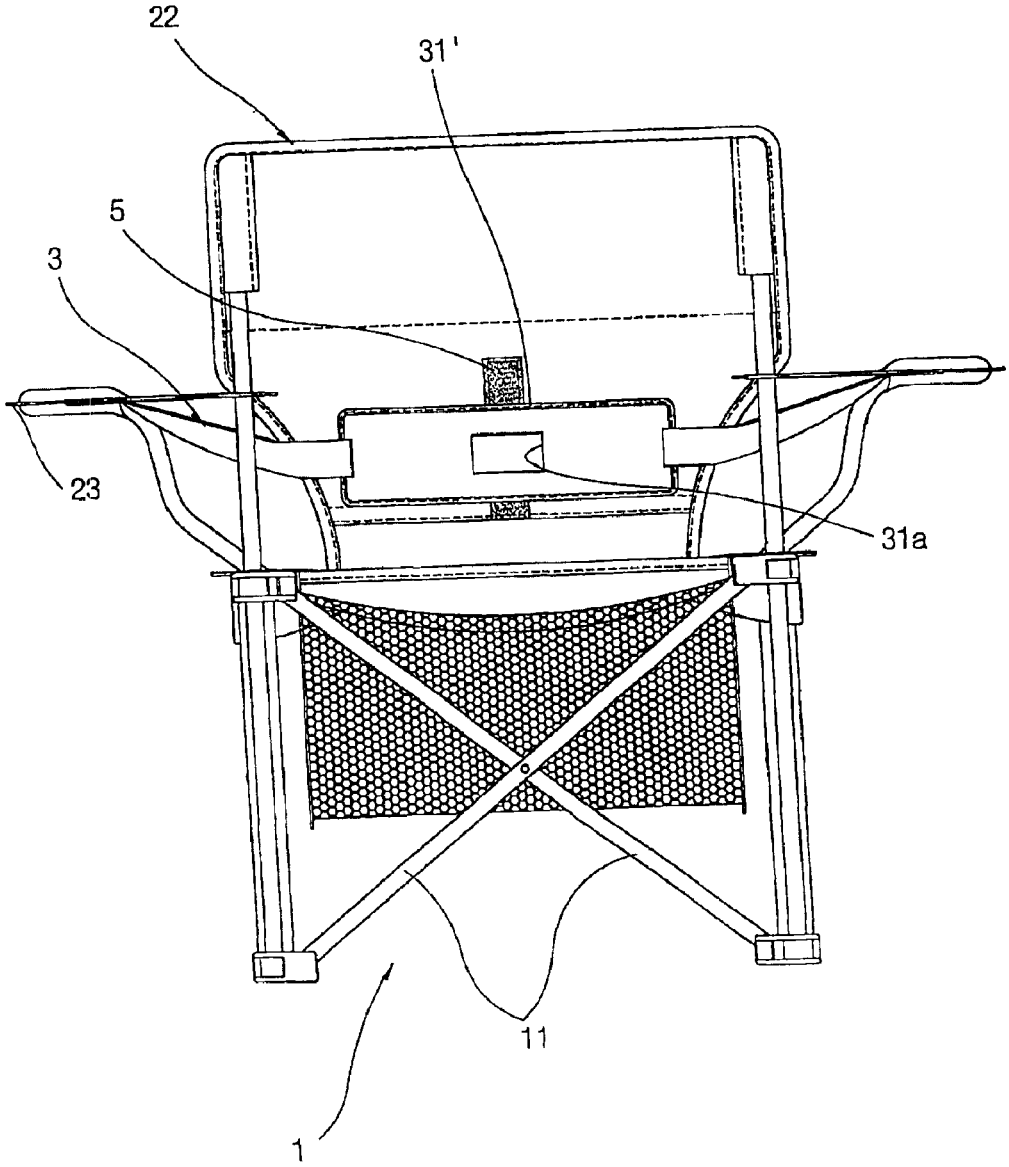

【FIG.12】
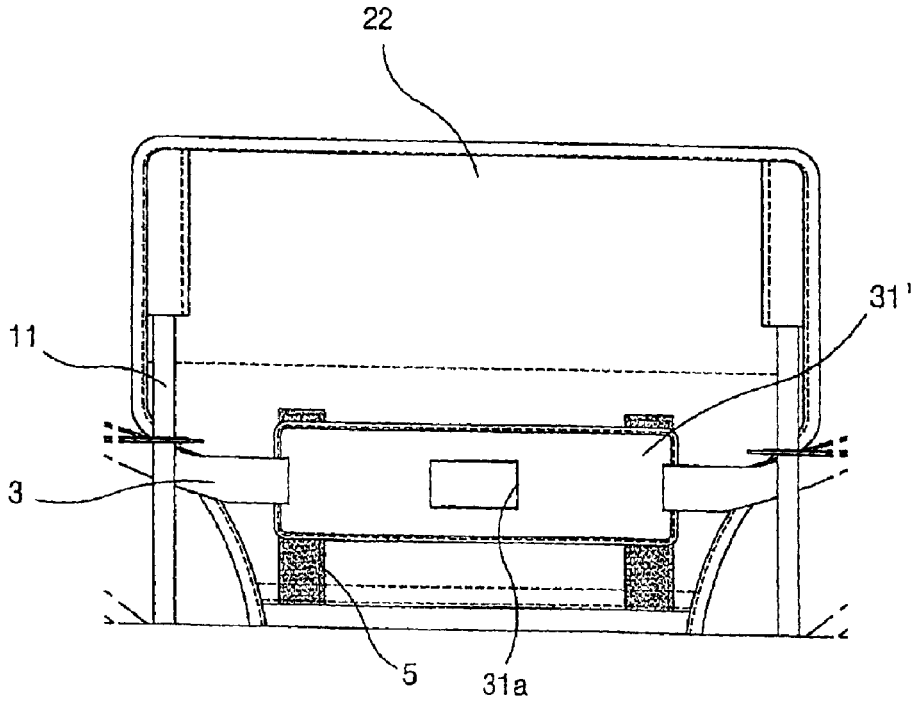

【FIG.13】
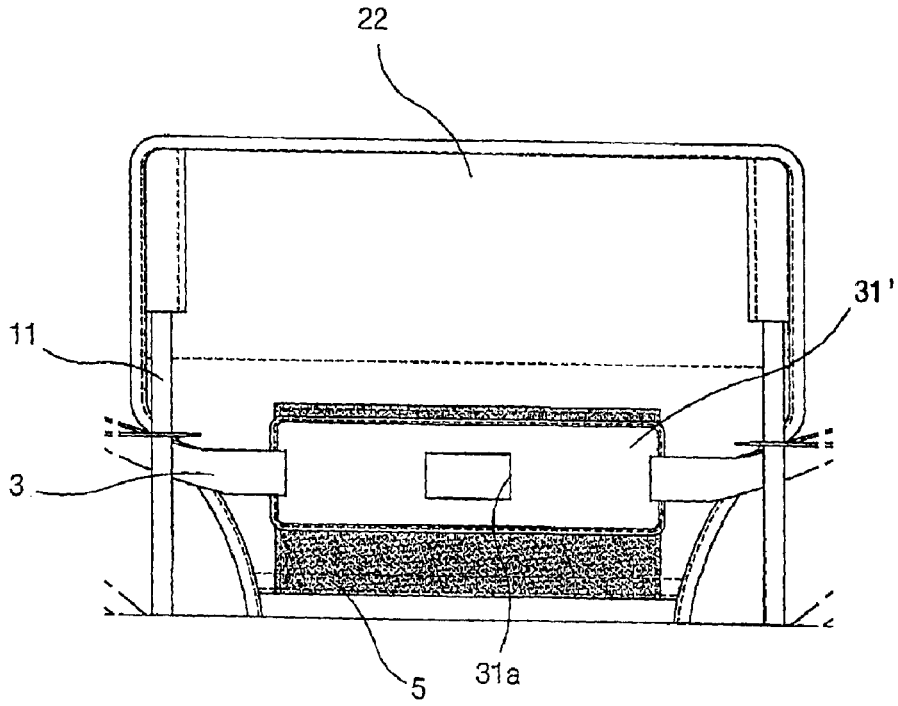

【FIG.14】
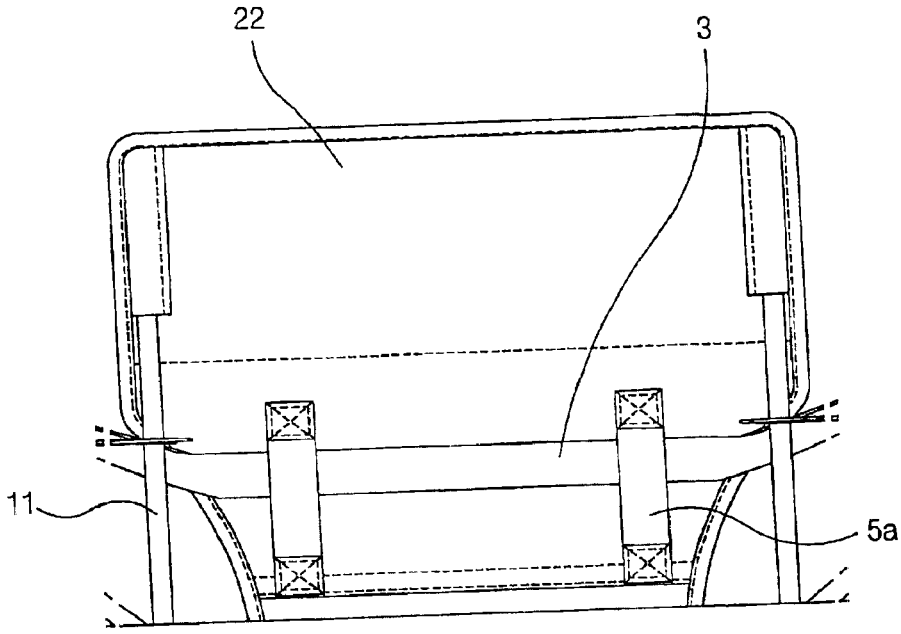
【FIG.15】
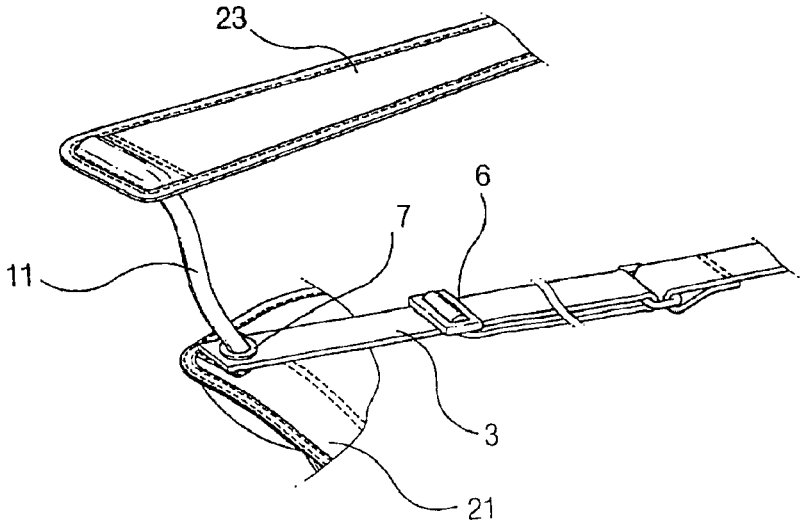

【FIG.16】
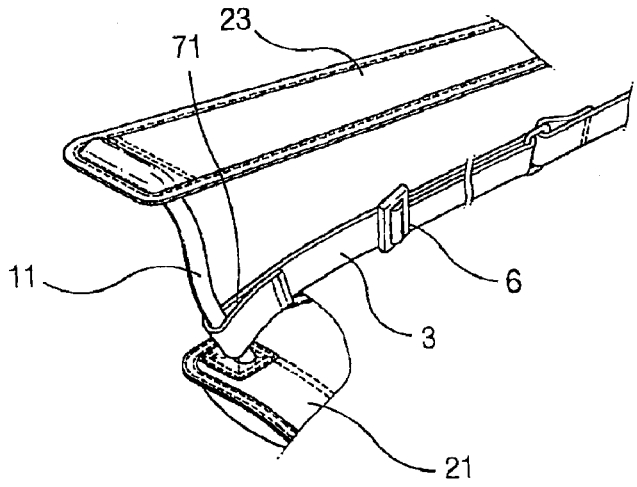
【FIG.17】
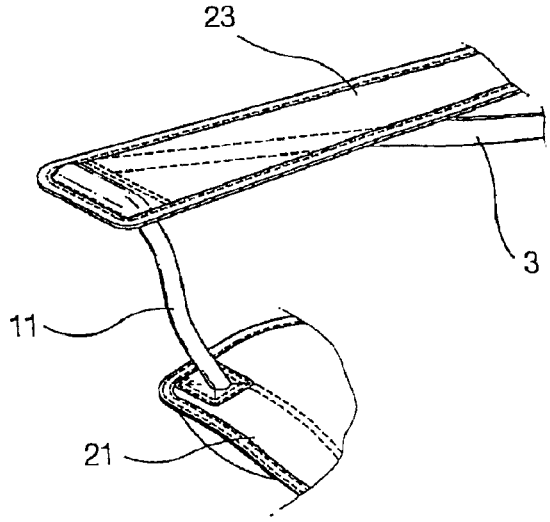

【FIG.18】
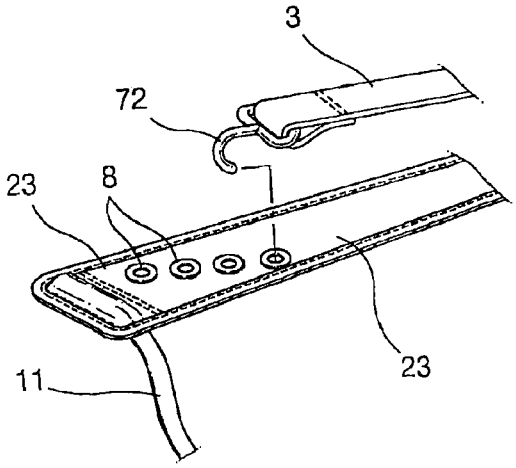
【FIG.19】
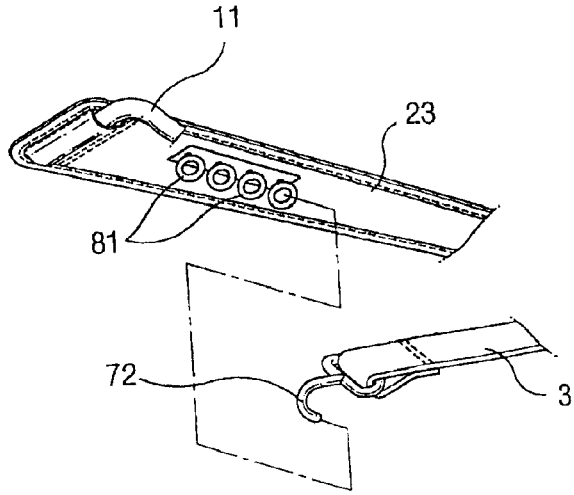

【 FIG.20 】
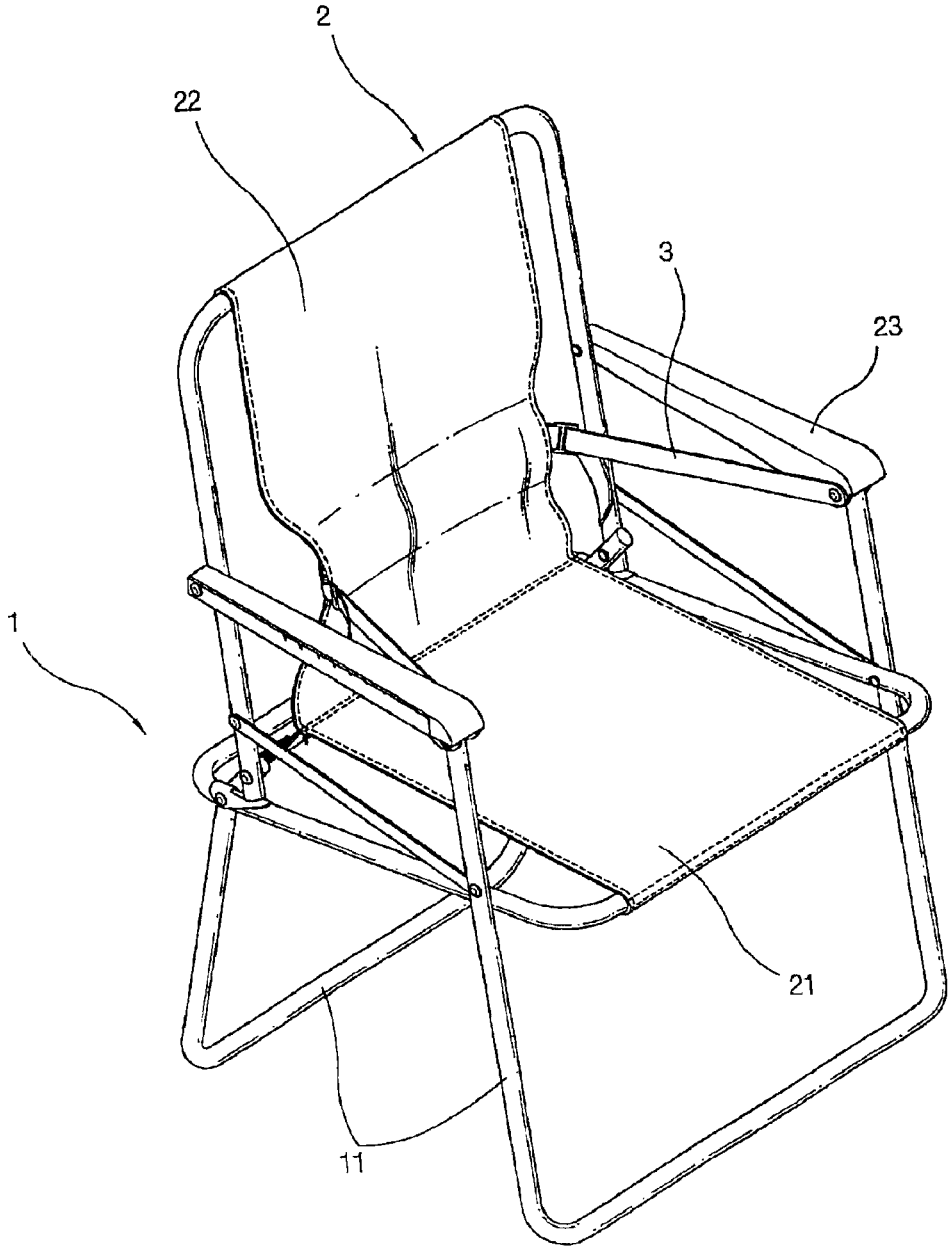

【FIG.21】
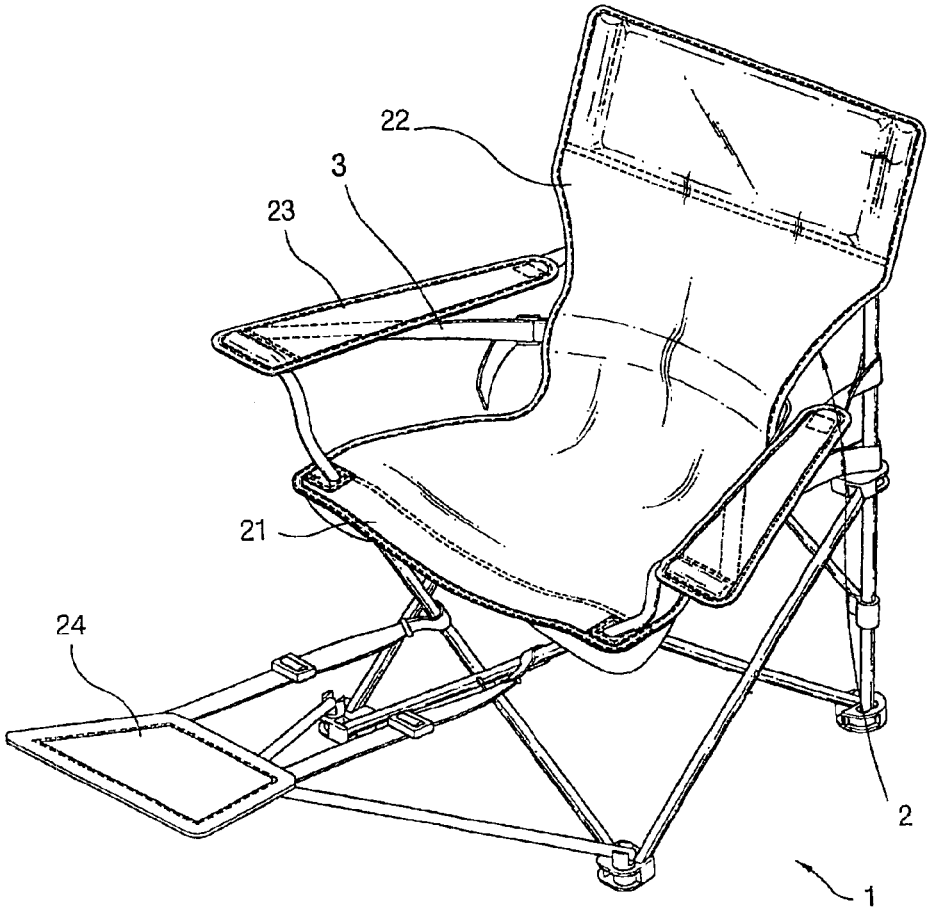

【FIG.22】
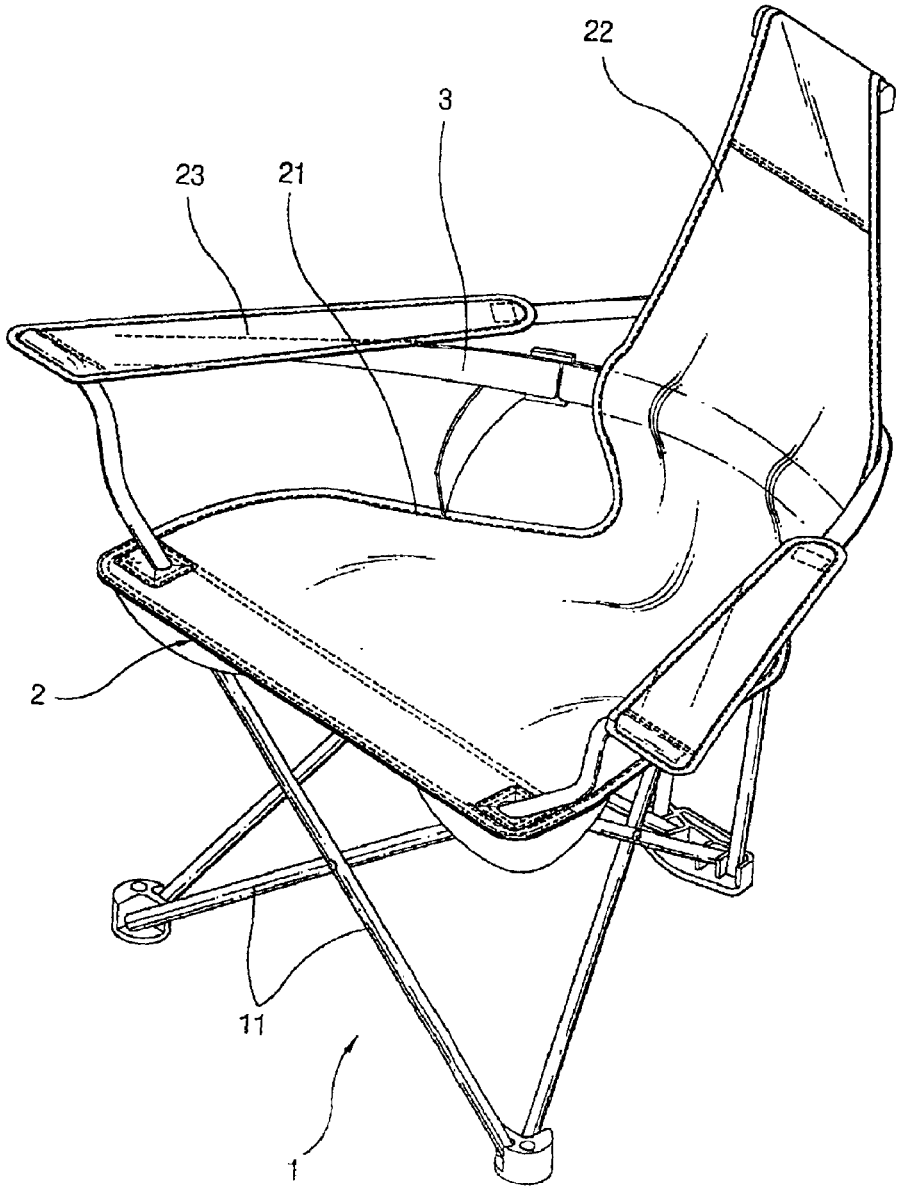

【FIG.23】
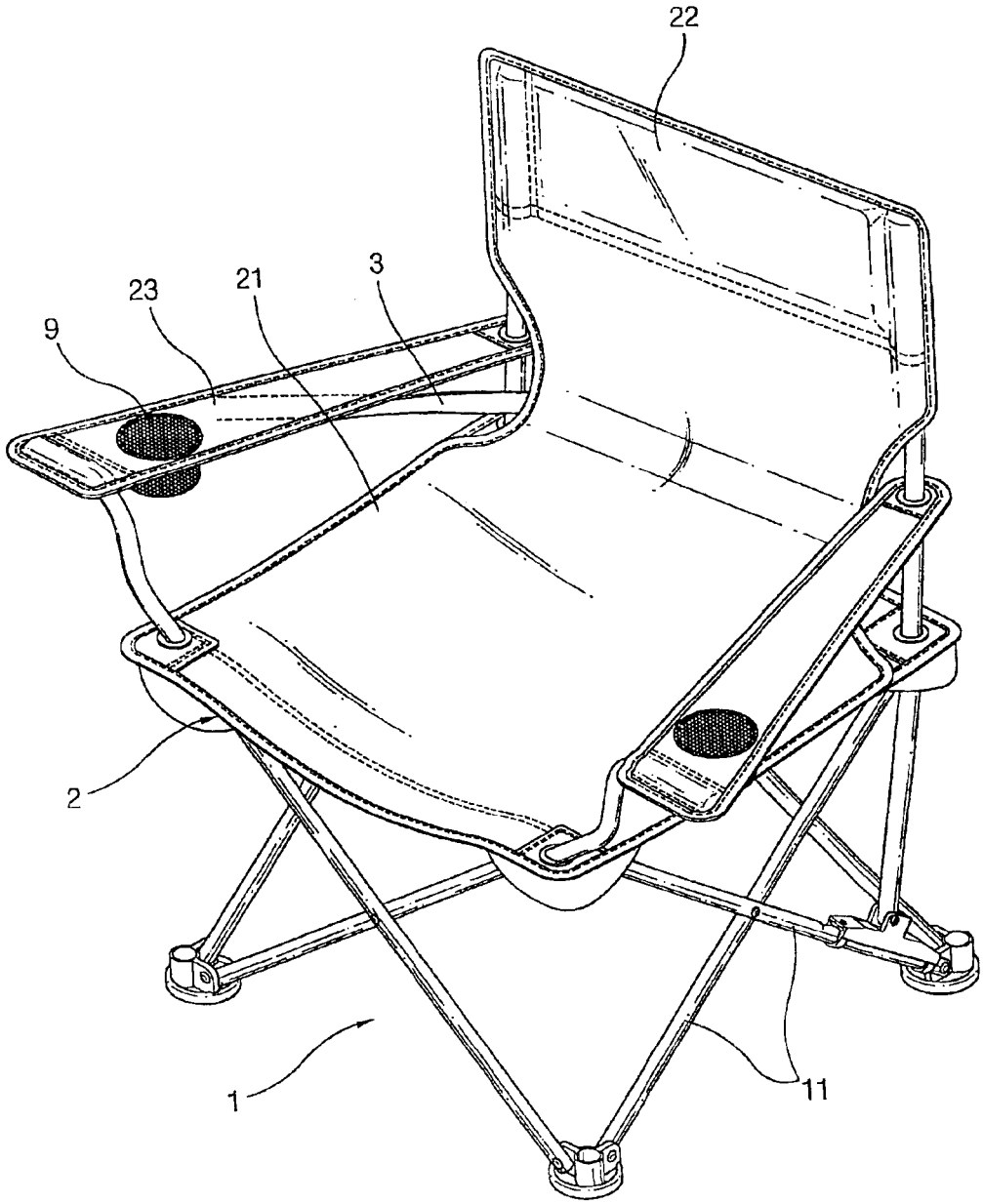

【FIG.24】
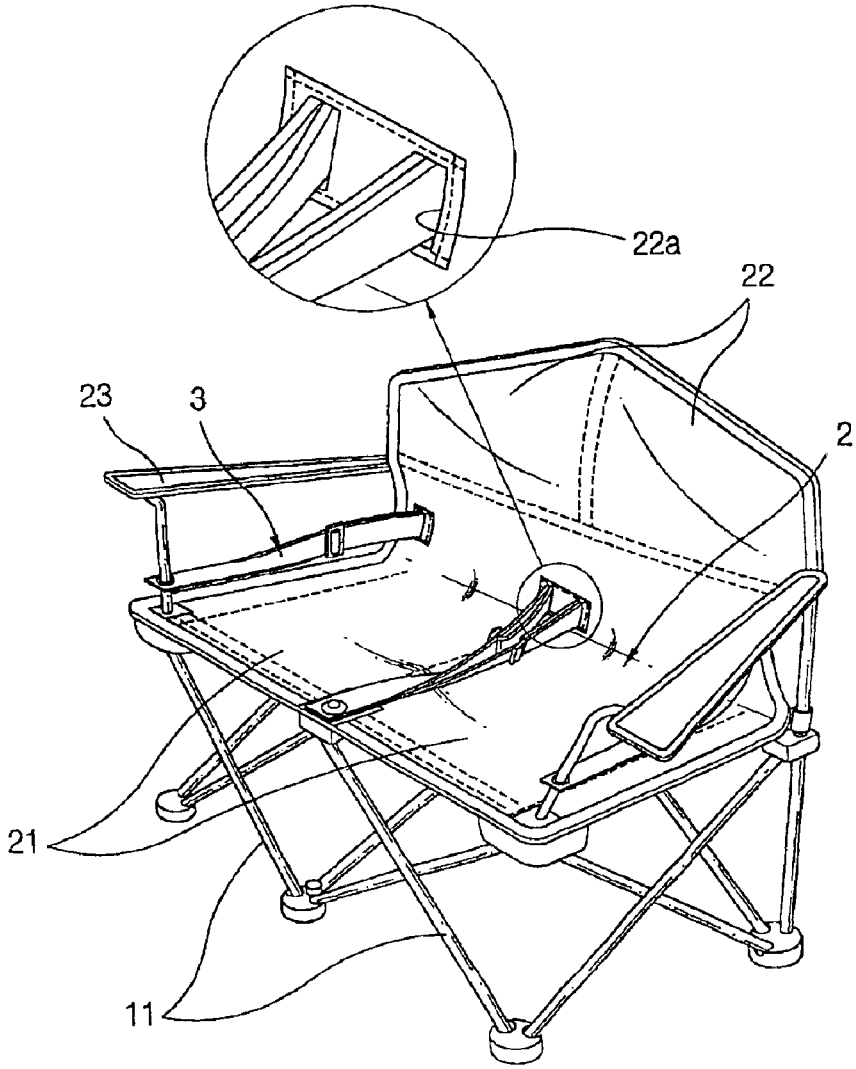

【FIG.25】
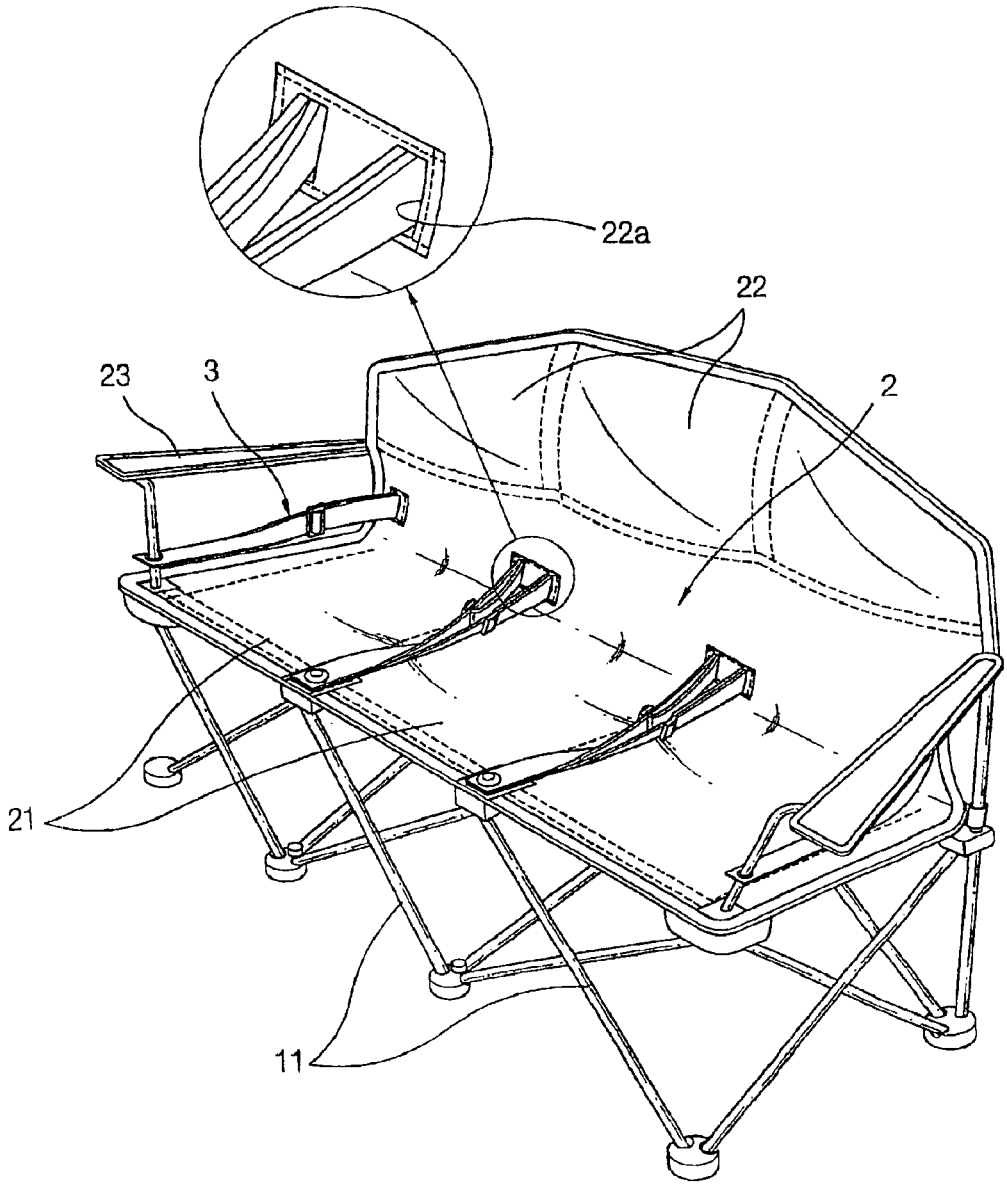

FOLDING CHAIR

TECHNICAL FIELD

The present invention relates, in general, to a folding chair and, more particularly, to a folding chair intended to be diversified in its application and convenient for seating, which is provided with means for protecting a user's vertebral column and means for expanding and stably supporting a seat portion, whereby the folding chair can afford comfortable and stable seating feeling and protection for vertebral column to a user and can prevent various afflictions caused by unstable seating posture of a user.

BACKGROUND ART

As well known to those skilled in the art, a usual conventional folding chair is constructed in such a way that frame elements constituting frame legs are crossed with one another to form a frame of a predetermined shape and then a seat sheet of a desired shape is held on the frame by means of appropriate joint means. Alternatively, a conventional folding chair may be constructed in such a way that a frame is prepared by providing support frame elements mounted on rear base members with slide members slidably inserted thereon, connecting side frame elements constituting side frame legs between the base members and upper connecting members and between the slider members and lower connecting members to form an "X" shape, and connecting front frame elements constituting front frame legs between the upper and lower connecting members to form an "X" shape, and then a fabric seat sheet is held on the frame.

However, the above-mentioned conventional folding chair is no more than a simple folding chair in its application, and thus cannot afford diverse uses and seating comfort and stability to a user.

Such a conventional folding chair is merely intended to ensure ease of its carriage and storage, and is well known to those skilled in the art.

Furthermore, various improvements of the above folding chair have been proposed by the applicant and have been put to practical use. Also, the above folding chairs are equipped with various functions to improve convenience of its manipulation, and they are previously in applied, pending or patented status.

More specifically, the above mentioned folding chairs and the applicant's folding chairs allow carriage in folded state, ease of storage and convenient use in unfolded state. Furthermore, the folding chairs are equipped with various functions such as attachment of a foot rest and storage of miscellaneous articles to further improve a user's convenience.

However, the improvements of the folding chairs are no more than slight increase in their convenience and applications, and they cannot afford seating comfort and stability and protection for a user's vertebral column in use.

In other words, because the folding chairs are constructed by fixedly coupling corner portions of seat sheets to front frame legs and rear frame legs, a user's buttock and vertebral column portions are positioned at the center of the seat sheet, thereby causing the center portion of the seat sheet to droop and thus the user's buttocks are positioned between the plane defined by the fixed corners and the ground surface. As a result, even when the user moves slightly, the folding chairs is easily shaken or falls down.

Since such an unstable seating posture may give the user unreasonable discomfort, patients suffering disease cause by abnormal disk and weak vertebral column cannot use the folding chairs. In addition, even a user with a healthy body is liable to suffer backache when he or she sits in the chair for a long time.

The above problems are brought about by the fact that a seat sheet cannot be rigidly secured to the frame element, and a profile defined between a neck portion and a buttock of a user assumes an arched shape, thereby giving his of her vertebral column unreasonable load when the user sits in the folding chair. Consequently, occurrence of backache is inevitable after long hours of seating, such as while fishing and reading.

Furthermore, since two front corners of a seat sheet are coupled to and supported by front frame legs and two rear corners are coupled to and supported by rear frame legs, a user's body weight is concentrated on the center of a seat sheet, thereby causing a user's buttock portion to be positioned under his knees to have abnormal posture.

In such a posture, because the two front corners of the seat sheet are supported by the front frame legs, a supporting line is generated at a front side of the seat sheet. Therefore, the supporting line thus hinders smooth blood circulation of femoral area, thereby causing legs and feet to be numbed after long hours of seating.

DISCLOSURE OF THE INVENTION

Accordingly, the present invention has been made keeping in mind the above problems occurring in the prior art, and an object of the present invention is to provide a folding chair which is provided with means for protecting a user's vertebral column and means for expanding a seat sheet so as to give a user seating comfort and stability, and prevention of various afflictions caused by unstable body posture.

Another object of the present invention is to apply the means for protecting a user's vertebral column and the means for expanding a seat sheet to many of types of folding chairs.

A further object of the present invention is to provide a folding chair which is provided at its back rest with detachable holding means for allowing the means for protecting a user's vertebral column to be disposed at a desired position.

A further object of the present invention is to provide a folding chair which is provided at its back rest with a plurality of bands, each having upper and lower ends attached thereto, to allow the means for protecting a user's vertebral column to be laterally moved therein while being maintained in position, so that the means is positioned at a predetermined position.

A further object of the present invention is to provide a folding chair which is provided at its back rest with means for protecting a user's vertebral column, which can be releasably attached thereto, coupled at its opposite ends to arm rests and adjusted in its length in accordance with a user's body type.

In order to accomplish the above object, the present invention provides a folding chair including a frame constructed by a plurality of frame elements, and a seat unit held on the frame by means of holding means and having a seat portion and a back rest portion which are integrally formed, comprising: means for outwardly expanding the seat portion of the seat unit, which are connected to both sides of the seat portion, and means for protecting a user's vertebral column by supporting the back rest portion, which is coupled at its opposite ends to arm rests held on upper portions of front frame elements.

The means for protecting a user's vertebral column may be held on a back rest of the chair by holding means which allows the protecting means to be moved. The means for protecting a user's vertebral column may be coupled to arm rests, frame elements or the expanding means. One or more means for protecting a user's vertebral column may be provided in the folding chair, as required.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view showing a folding chair according to the most preferable embodiment of the present invention;

FIGS. 2 to 5 are perspective views showing expanding means and associated components of the invention;

FIG. 6 is a perspective view showing a folding chair to which only expanding means of the invention is applied;

FIG. 7 is a perspective view showing a folding chair of a second embodiment of the invention having means for protecting a user's vertebral column;

FIGS. 8 and 9 are perspective view showing folding chairs which are provided with only protecting means of the invention;

FIG. 10 is a side elevation view showing a protecting means of the invention in use;

FIG. 11 is a rear view of a folding chair having another embodiment of protecting means according to the invention;

FIGS. 12 to 14 are rear views of a folding chair having further embodiments of protecting means according to the invention;

FIG. 15 is a perspective view showing a way for coupling ends of protecting means of the invention to frame elements;

FIG. 16 is a view similar to FIG. 15, but showing another way for coupling ends of protecting means of the invention to frame elements;

FIG. 17 is a view similar to FIG. 15, but showing a further way for coupling ends of protecting means of the invention to frame elements;

FIG. 18 is a view similar to FIG. 15, but showing a further way for coupling ends of protecting means of the invention to arm rests;

FIG. 19 is a view similar to FIG. 15, but showing a further way for coupling ends of protecting means of the invention to arm rests;

FIG. 20 is a perspective view showing another type of folding chair having means for protecting a user's vertebral column of the invention;

FIGS. 21 to 23 are perspective views showing further types of folding chairs having the protecting means of the invention; and FIGS. 24 and 25 are perspective views showing two-person and three-person folding chairs to which the protecting means of the invention are applied.

BEST MODE FOR CARRYING OUT THE INVENTION

Reference now should be made to the drawings, in which the same reference numerals are used throughout the different drawings to designate the same or similar components.

FIGS. 1 to 19 show folding chairs according to embodiments of the present invention. As shown in the drawings, the folding chair of the invention comprises a frame 1 constructed by a plurality of frame elements 11, and a seat unit 2 held on the frame 1 by means of usual holding means and having a seat portion 21 and a back rest portion 22 which are integrally formed.

The seat portion 21 of the seat unit 2 is provided at its opposite sides with longitudinal expanding pockets 4. Vertebral column-protecting means is provided under the back rest portion 22, which is supported by arm rests 23 provided at both sides of the frame 1.

Each of the longitudinal expanding pockets 4 is made of fabric and outwardly extended from the seat portion 21 of the seat unit 2 to have a predetermined width, and stitched along its peripheral edge with a front end being opened to have an insertion hole 21*a* therein, as illustrated in FIG. 2.

A support hanger 11*a* of a predetermined length is inserted into each of the insertion holes 21*a*, which is formed by bending an upper end of each of the front crossed frame legs 11, so that the seat portion 21 can be expanded by outward motion of the support hangers 11*a*.

The expanding pockets 4 downwardly pushes the seat portion 21 by a user's body weight, and the body weight is transmitted to support hangers 11*a* of the front crossed frame legs 11 to further expand the seat portion 21, when a user sits down on the seat portion 21.

Consequently, compressed areas of femora of a user, on which body weight of the user is concentrated, are enlarged. With such enlargement of compressing areas of femora, the user can comfortably rest without obstruction of blood circulation, even in case of long hours of seating.

The support hangers 11*a* of the front crossed flame legs 11 are constructed such that upper ends of the crossed frame legs 11 are rearwardly bent to have predetermined lengths and then arm rest hangers 11*b* intended for supporting the arm rests 23 are separately attached to bent portions of the crossed frame legs, as shown in FIGS. 2 and 3.

Alternatively, the support hangers 11*a* may be constructed such that upper portions of the crossed frame legs 11 are rearwardly bent by predetermined lengths and then forwardly bent, and the upper ends thereof are outwardly bent to form the arm rest hangers 11*b*, as shown in FIGS. 4 and 5.

In the embodiment shown in FIG. 3, the seat unit 2 is provided at its front side with extending straps 21*b*, each of which is stitched at its opposite ends the seat unit to form a ring. The pair of crossed frame legs 11 are provided with slide pads 11*c*, respectively, which are slidably inserted over the upper sections of the crossed frame elements 11. Each of the slide pads 11*c* is provided at its side with a pair of protrusions, at each of which is formed a pin hole 11*d* to be inserted with a pin 11*e*. Therefore, the extending straps 21*b* can be preferably connected to the slide pads 11*c* by inserting the pins 11*e* into the holes of the extending straps 21*b* through the pin holes 11*d* of the slide pads 21*b*.

FIG. 6 shows another embodiment of a folding chair according to the present invention, which has longitudinal expanding pockets 4. The folding chair shown in the drawing is designed for cases where it is unnecessary to have arm rests. In this case, the front crossed frame legs 11 are rearwardly bent at upper ends thereof to form support hangers 11*a* each having a predetermined length. The support hangers 11*a* are inserted into the holes 21*a* of the expanding pockets 4 to tightly support the seat unit 2.

FIG. 7 shows a further embodiment of a folding chair according to the present invention. In this embodiment, a vertebral column-protecting means 3 is connected at its opposite ends to the longitudinal expanding pockets 4 or ends of the support hangers 11*a* of the front crossed frame legs 11.

The vertebral column-protecting means as mentioned above will now be described in detail.

Although it is preferable that the vertebral column-protecting means 3 is coupled at its opposite ends to the arm rest 23 held on the front crossed frame legs 11 by stitching, the vertebral column-protecting means 3 may be directly coupled to upper ends of the front crossed frame legs 11, if required.

Furthermore, although it is preferable that the vertebral column-protecting means 3 comprises only one band having predetermined length and width, the vertebral column-protecting means 3 may be releasably provided at its middle portion with an additional enlarged supporting member 31, as illustrated in FIG. 9.

In this case, the enlarged supporting member 31 is preferably enlarged toward its middle portion to form an approximately elliptical shape, and is attached to the vertebral column-protecting means 3 by stitching.

Alternatively, the vertebral column-protecting means 3 may be provided at its middle portion with an additional enlarged rectangular member 31', as illustrated in FIGS. 11 to 13. In this case, the rectangular member 31' is provided with slits 31*a* so that the band-shaped vertebral column-protecting means 3 can pass therethrough while alternately going along its front surface and rear surface. Therefore, the rectangular supporting member 31' can be moved from side to side by a user.

The band material constituting the vertebral column-protecting means 3 is positioned to be contact with a back surface of the back rest portion 22 of the seat unit 2.

In an embodiment shown in FIG. 14, a back surface of the back rest portion 22 is provided at its both sides with a pair of holding bands 5*a*, each of which is of a predetermined length and is vertically positioned. Each of the holding bands 5 is stitched at its upper and lower ends to the back rest portion 22 to define a passage between the upper and lower ends. The vertebral column-protecting means 3 passes through the passages of the pair of holding bands 5*a* so that the vertebral column-protecting means 3 cannot be separated from the back rest portion. Therefore, when a user sits in the folding chair, i.e. the seat unit 21, the back rest portion 22 will be positioned at the vertebral column portion of the user by the vertebral column-protecting means 3 so that the vertebral column-protecting means 3 can comfortably support the vertebral column of the user.

In embodiments shown in FIGS. 11 to 13, a back surface of the back rest portion 22 of the seat unit 2 is provided at its lower portion with one or more Velcro fasteners 5 each having a predetermined surface area. The enlarged supporting member 31, 31' is also provided at its inner surface with the mating Velcro fasteners to be detachably attached to the Velcro fastener 5 of the back rest portion 22. Consequently, a user can easily adjust height of the vertebral column-protecting member 3 and the enlarged supporting member 31, 31' by means of the Velcro fasteners in accordance with his body type.

The reason why the vertebral column-protecting means can efficiently fulfill its protecting role is that the vertebral column-protecting means 3 is coupled at its opposite ends to the arm rests 23 or upper ends of the frame legs 11 adapted to support the arm rests 23 so that the vertebral column-protecting means 3 inhibits the back rest portions 23 from drooping or from being expanded.

To this end, the opposite ends of the vertebral column-protecting means 3 is coupled to the arm rests 23 by using stitching or usual coupling means, and the vertebral column-protecting means 3 is provided with a length adjusting means 6 which enables a length of the vertebral column-protecting means 3 to be easily adjusted in accordance with user's body type.

The vertebral column-protecting band means 3 may be provided at its opposite ends with separate eyelets 7 so that the eyelets 7 can be slid along the crossed frame elements 11 during assembly of the folding chair, as illustrated in FIG. 15.

Alternatively, the opposite ends of the vertebral column-protecting means 3 may be folded and then stitched so as to form ring-shaped straps 71, as illustrated in FIG. 16. With the ring-shaped straps 71, the ends of the vertebral column-protecting means 3 can be also slid along the crossed frame elements 11.

FIGS. 18 and 19 show means for connecting ends of the vertebral column-protecting means 3 to the arm rests 23.

In an embodiment shown in FIG. 18, the vertebral column-protecting means 3 is provided at its opposite ends with hooks 72, and the arm rests are provided with a plurality of eyelets 8. Therefore, a user can adjust length of the vertebral column-protecting means 3 in accordance with his body type by coupling the hook 72 to a corresponding one of the eyelets 8.

Alternatively, an embodiment shown in FIG. 19 includes a plurality of rings 81 attached to the lower surface of the arm rest 23 so as to cause the hook 72 to be disposed under the arm rest 23. Therefore, this embodiment is intended for alleviating or eliminating inconvenience caused by the hooks 72 or the vertebral column-protecting means 3 disposed on the arm rest 3 as well as adjusting the length of the vertebral column-protecting means in accordance with a user's body type.

FIG. 20 shows a folding chair adapted to be folded and unfolded in another way, to which the principle of the present invention is also applied.

As shown in the drawing, the folding chair includes the frame 1 composed of a plurality of bent frame elements 11 and the seat unit 2 composed of the seat portion 21 and the back rest portion 22. A plurality of tension springs are connected to a back surface of a linear bent portion positioned at a boundary between the back rest portion 22 and the seat portion 21 of the seat unit 2 so that body weight of a user can be supported by the tension springs when being sat by the user.

Such a chair may encounter the problems as mentioned in the introduction of the specification. As is the case with the above-mentioned embodiments, the folding chair is provided the vertebral column-protecting means 3 such that the vertebral column-protecting means 3 is positioned at a lower portion of the back rest portion 22. The vertebral column-protecting means 3 may be held on the back rest portion 22 by attaching additional holding bands, Velcro fastener or another holding means, and may be fixed at its opposite ends to arm rests or front frame elements by appropriate fixing means.

FIGS. 21 to 23 show other folding chairs to which the vertebral column-protecting means 3 of the invention is applied. That is, FIG. 21 shows a folding chair having a foot rest assembly which is releasably installed thereto, FIG. 22 shows a folding chair having a frame which is composed in another way, and FIG. 23 shows a folding chair which is provided with a tilting apparatus for the back rest portion, and cup holders 9 disposed at front portions of the arm rest 23.

The vertebral column-protecting means, which are applied to the folding chairs illustrated in the drawings, are also fixedly or releasably coupled at its opposite ends to the arm rests 23, as is the case with the above embodiments. Furthermore, the folding chairs are provided at their back rest portion with the holding means for holding the vertebral column-protecting bands, which are also fixedly or detachably attached to the back surface of the back rest portion.

In the embodiments shown in FIGS. 8 to 23, although there are shown only the vertebral column-protecting means, the folding chairs according to the embodiments may of course have the expanding pockets 4. The expanding pockets 4 may be embodied into various modifications depending on the type or the folding way of the chairs.

FIGS. 24 and 25 show commonly used two-person and three-person folding chairs which are also provided with the vertebral column-protecting means 3 of the present invention so as to provide a user with the sense of comfort and stability and to protect user's vertebral column.

In the embodiments shown in the drawings, the two-person and three-person folding chairs have two and three vertebral column-protecting bands 3, respectively, which are coupled at their opposite ends to upper ends of the front crossed frame elements 11 and disposed at a lower portion of a rear surface of a back rest portion 22.

The vertebral column-protecting bands 3 are adapted to pass through slots 22*a* formed at a lower portion of the back rest portion 22 so that the vertebral column-protecting bands 3 can individually move through the slots 22*a*.

Of course, the folding chairs of these embodiments may have means for adjusting lengths of the vertebral column-protecting bands, means for holding the bands in the back rest portion, and additional components such as foot rests and cup holders in the same way as those of the above embodiments.

INDUSTRIAL APPLICABILITY

As described above, the present invention provides a folding chair having vertebral column-protecting means and means for expanding its seat unit so that a user can feel comfort and stability and can be protected from injury to his vertebral column. Consequently, the folding chair of the present invention can protect a user from various diseases caused by unstable seating posture and can multiply comfort and stability. Since the vertebral column-protecting band can be appropriately applied to many kinds of chairs depending on structures and use of chairs, its range of application become considerably wide, Furthermore, since the vertebral column-protecting band can be held in the back rest portion by means of holding bands, or it can be attached to the back rest portion by means of attaching means such as Velcro fastener so that position of portion of the back rest portion which is supported thereby can be conveniently varied.

Although the preferred embodiments of the present invention have been described with reference to specific folding chairs, it should be understood that the invention is not limited to the illustrated specific embodiments but can be also applied to various chairs composed of frame elements joined by joint means. In addition, since a vertebral column-protecting band of the invention can be appropriately applied to various folding chairs in accordance with their configuration and use, the invention can be applied to any chairs based on folding mechanism. Those skilled in the art will appreciate that various modifications, additions and substitutions are possible, without departing from the scope and spirit of the invention as disclosed in the accompanying claims.

What is claimed is:

1. A folding chair including a frame constructed by a plurality of frame elements including front frame elements, and a seat unit held on the frame by means of holding means and having a seat portion and a back rest portion which are integrally formed, comprising:

means connected to both sides of the seat portion for outwardly expanding the seat portion;

a pair of arm rests held on upper portions of the front frame elements, with an arm rest on each of two opposite sides of said chair; and means coupled at its opposite ends to the arm rests for protecting a user's vertebral column by supporting the back rest portion.

2. A folding chair including a frame constructed by a plurality of frame elements, and a seat unit held on the frame by means of holding means and having a seat portion and a back rest portion which are integrally formed, comprising:

means connected to both sides of the seat portion for outwardly expanding the seat portion;

a pair of arm rests held on upper portions of front frame elements, with an arm rest on each of two opposite sides of said chair; and means coupled at its opposite ends to the arm rests for protecting a user's vertebral column by supporting the back rest portion;

wherein the expanding means is made by stitching portions extended from both sides of the seat portion to form pockets of predetermined width each having a hole, and support hangers, which are formed by rearwardly bending upper ends of the front frame elements, are inserted in the holes of the pockets, whereby the seat portion can be expanded by extending motions of support hangers of the frame elements.

3. The folding chair as set forth in claim 2, wherein the upper ends of the frame elements are provided at their upper surfaces or lower surfaces with additional arm rest hangers for supporting arm rests.

4. The folding chair as set forth in claim 2, wherein the frame elements are rearwardly bent at their upper portion to form the support hangers and then outwardly bent at their upper ends to form the arm rest hangers.

5. The folding chair as set forth in claim 2 or 3, wherein the seat portion is provided at its front sides with extending straps each having a hole, and the front frame elements are provided with slide pads having holes into which the front frame elements are inserted and which have connecting pins adapted to be coupled to the extending straps.

6. The folding chair as set forth in claim 2 or 3, wherein the vertebral column-protecting means is coupled to the expanding pockets or the upper bent ends of the front frame elements.

7. The folding chair as set forth in claim 2, wherein the vertebral column-protecting means is coupled at its opposite ends to upper ends of the front frame elements by which the arm rests are supported.

8. The folding chair as set forth in claim 2 or 7, wherein the vertebral column-protecting means comprises a band body having a predetermined length and a predetermined width.

9. The folding chair as set forth in claim 8, wherein the band body is provided at its middle portion with an additional enlarged supporting member fixed thereto, and the enlarged supporting member is increased in its width toward its middle portion to form an approximately elliptical shape.

10. The folding chair as set forth in claim 8, wherein the band body is provided at its middle portion with an additional enlarged rectangular supporting member adapted to slide therealong, and the rectangular supporting member is formed with slits through which the band body passes, so that the rectangular supporting member is moved along the band body from side to side by a user.

11. The folding chair as set forth in claim 8, wherein the band body constituting the vertebral column-protecting means is disposed to be in contact with a rear surface of the back rest, and the rear surface of the back rest is vertically provided at its both sides with a pair of holding bands, each of the holding bands being stitched at its upper and lower ends to form a passage therebetween, so that the holding bands slidably confined in the holding bands are disposed at a user's vertebral column and stably support the user's vertebral column when the user sits down on the seat portion.

12. The folding chair as set forth in claim 8, wherein the back rest portion is provided at a lower portion of its rear surface with one of a hook or loop fastener fixedly attached thereto, and the band body is provided with a correspondingly mating loop or hook fastener, so that the band body is detachably attached to the back rest portion.

13. The folding chair as set forth in claim 8, wherein the band body is provided at its opposite ends with eyelets which are inserted over the front frame elements during assembly of the folding chair.

14. The folding chair as set forth in claim 8, wherein the band body is provided at its opposite ends with ring-shaped straps which are made by stitching ends of the band and which are inserted over the front frame elements during assembly of the folding chair.

15. The folding chair as set forth in claim 8, wherein the vertebral column-protecting means is provided at its opposite ends with hooks and the arm rest is provided with a plurality of eyelets so that the vertebral column-protecting means is adjusted in its length depending on body type of a user by connecting the hooks of the vertebral column-protecting means to desired eyelets of the eyelets.

16. The folding chair as set forth in claim 15, wherein the arm rest is longitudinally provided at its lower surface with a plurality of rings attached thereto, and the hooks of the vertebral column-protecting means are coupled to the rings.

17. The folding chair as set forth in claim 8, wherein the folding chair is adapted to accommodate two or three persons, and thus the corresponding number of vertebral column-protecting means are prepared therein and coupled at their opposite ends to upper ends of the front frame elements, wherein the vertebral column-protecting means pass through slots formed at the back rest portion such that the vertebral column-protecting means are disposed at a lower portion of the back rest portion.

18. The folding chair as set forth in claim 2, wherein the vertebral column-protecting means is coupled at its opposite ends to the arm rest by stitching.

19. The folding chair as set forth in claim 2 or 7, wherein the vertebral column-protecting means is provided with means for adjusting length of the vertebral column-protecting means to allow the vertebral column-protecting means to be easily shortened or lengthened depending on body type of a user.

20. The folding chair as set forth in claim 2, wherein a plurality of tension springs are coupled to a corner portion of the seat unit corresponding to a boundary between the seat portion and the back rest portion so as to support body weight of a user when the user sits down on the seat unit.

* * * * *